US006203113B1

(12) United States Patent
Wendel

(10) Patent No.: US 6,203,113 B1
(45) Date of Patent: Mar. 20, 2001

(54) CUTTING DRUM WITH PERCUSSIVE BITS

(76) Inventor: Nick Wendel, Garssloh 45, Celle (DE), 29229

( * ) Notice: Subject to any disclaimer, the term of this patent is extended or adjusted under 35 U.S.C. 154(b) by 0 days.

(21) Appl. No.: 09/199,389

(22) Filed: Nov. 25, 1998

(30) Foreign Application Priority Data

Dec. 9, 1997 (DE) ..... 197 54 371

(51) Int. Cl.[7] ..... E21C 27/12; E21C 35/18

(52) U.S. Cl. ..... 299/100; 299/39.4; 299/37.3; 299/69

(58) Field of Search ..... 299/39.4, 39.7, 299/39.8, 39.9, 53, 79.1, 69, 106, 107, 14, 100, 37.3, 37.5; 173/205, 124

(56) References Cited

U.S. PATENT DOCUMENTS 3,743,033 * 7/1973 Taylor ..... 173/4
3,778,106 * 12/1973 Taylor et al. ..... 299/1
3,778,113 * 12/1973 Taylor ..... 299/86
4,366,991 * 1/1983 Hilshorst ..... 299/39.1
5,335,977 * 8/1994 Morrell et al. ..... 299/106

FOREIGN PATENT DOCUMENTS 672 659 A5 12/1989 (CH) .
32 32 985 A1 3/1984 (DE) .
32 46 118 6/1984 (DE) .
33 01 671 C2 7/1984 (DE) .
30 22 317 C2 9/1985 (DE) .
32 49 690 8/1986 (DE) .
19634514 * 7/1997 (DE) .
0825003A2 * 2/1998 (EP) .

* cited by examiner

*Primary Examiner*—Eileen D. Lillis
*Assistant Examiner*—John Kreck
(74) *Attorney, Agent, or Firm*—James Creighton Wray; Meera P. Narasimhan

(57) ABSTRACT

A rotatable cutting drum to be mounted on a machine for mining or for milling a surface such as a roadway. The drum is equipped with a set of movable bits or chisels which impact on the surface to be cut. The movable bits or chisels are impacted by pendulums mounted on a rotating cylinder mounted inside of the drum so that a percussive force is generated to assist cutting.

23 Claims, 2 Drawing Sheets

CUTTING DRUM WITH PERCUSSIVE BITS

BACKGROUND OF THE INVENTION

The invention relates to a rotating milling machine for use in processing rocky materials, especially concrete, asphalt, and masonry.

Machines of this type are used, among other things, for milling off walls, floors, or roadways, or for milling grooves into such structures.

An acceptable degree of progress in milling, particularly in harder materials such as concrete, can generally be achieved only via the use of very heavyweight machinery, having a high level of driving power and a high rate of advance, and producing a severe vibration of the machines and a high degree of abrasion of the milling chisels.

For this reason, attempts have long been made to provide these chisels with a percussion effect similar to that of a percussion drill or a jackhammer. In the patents DE 196 31 659 and DE 196 34 514 this was achieved for the first time. Here, in the case of the compressed air design of the former patent, the cost of producing the compressed air, and thereby the overall costs, are still relatively high, the force of impact, especially in the case of smaller dimensions, is limited, and a high level of power is required for generation of the compressed air, due to a low level of efficiency in the generation of compressed air and losses through leakage in the milling cylinder.

In the latter patent, the force of impact is very limited, and the cams are eroded relatively rapidly, or they become overheated due to friction losses. The percussion principle in this patent is more like that of a percussion drill than that of the more effective jack hammer.

SUMMARY OF THE INVENTION

The object of the present invention is to provide a substantially higher level of percussion force with a lower level of impact driving power, and with a more simple, and thus more cost-efficient, lighter, and more fail-safe design.

The object is attained in accordance with the invention in that in some or all of the chisels a percussion effect is induced via pendulums rotating on the inside of the milling cylinder.

This design provides the following advantages over state-of-the-art designs:

(a) Impact force and frequency levels that are many times higher can be realized with the same structural dimensions, and at a lower production cost, and thereby at a lower overall cost. With a milling diameter of 550 mm and a milling width of 25 mm, this new design easily achieves an impact speed of 27 m/s with an impact mass of 1 kg. The impact frequency thus also easily reaches 4,000 beats per minute or more. This corresponds to a force of impact of 47 kw, probably too great for this width. Known-in-the-art systems allow an impact mass of approximately 0.3 kg at an impact speed of 7 m/s and a driving force of more than twice the force of impact.

(b) The percussion drive mechanism alone is more than twice as efficient, while the impact force directly supports the rotating power of the milling cylinder, and thus enables a lower level of driving power for the entire machine. This means smaller dimensions, and lower weights mean less in transportation costs, and enable expanded applications. Lower power and weight requirements mean less damage to the environment and lower operating costs.

(c) With a simpler design, a higher level of impact power and, more importantly, a safer, more trouble-free operation are achieved.

(d) The system is also substantially less susceptible to contamination, since it is not dependent upon narrow fits and practically particle-free guide borings, as known-in-the-art designs are.

In accordance with the invention, a milling cylinder 5 equipped with chisels that lie on the outside of the cylinder is rotated, while on the inside of the milling cylinder, a shaft that is equipped with pendulums rotates at a different rpm and/or direction of rotation.

The frequency of impact is derived from the relative rpm of the milling cylinder 5 and the pendulum shaft 4, and from the number of pendulums.

Aside from when they are in contact with the material being milled, no percussion effect is induced in the chisels, which serves to limit wear and tear on the parts of the machine. If the acceleration due to centrifugal force of the chisels in accordance with claim 14 is substantially higher than the acceleration due to gravity of approximately 9.81 m/s^2, then the chisels are pushed to their outer stop points, where they cannot come into contact with the pendulums.

Only when the chisels are embedded in the material being milled 9 are they pressed against their inside stop devices, causing the pendulums to strike against the chisels.

In accordance with claim 7, the point of impact of the pendulum, relative to the direction of rotation, lies behind the line that connects the point of rotation of the shaft and the point of rotation of the pendulum. Thus determined, the pendulum turns, at the same pendulum angle, farther toward the inside, away from the chisel, to smaller radii. The advantage of this is that only smaller pendulum angles must be allowed in order that the pendulums, after the striking the chisels, can rotate past the chisels more rapidly and safely and will also reach their initial outer position more rapidly, and thereby will strike the outer stop device at a lower speed, thereby causing less wear and tear on the outer stop device for the pendulum.

To better understand claim 12, it is helpful to consider the concept of the game of billiards. Depending upon the angle of impact, the ball that is impacted is struck in a direction 10 that differs from the direction 11 of the approaching ball.

Further details and advantages of the object of the invention are provided in the following description of the attached diagrams, in which preferred exemplary embodiments are illustrated, with the key details and individual components indicated. These show:

DETAILED DESCRIPTION OF THE PREFERRED EMBODIMENT

Figure 1:
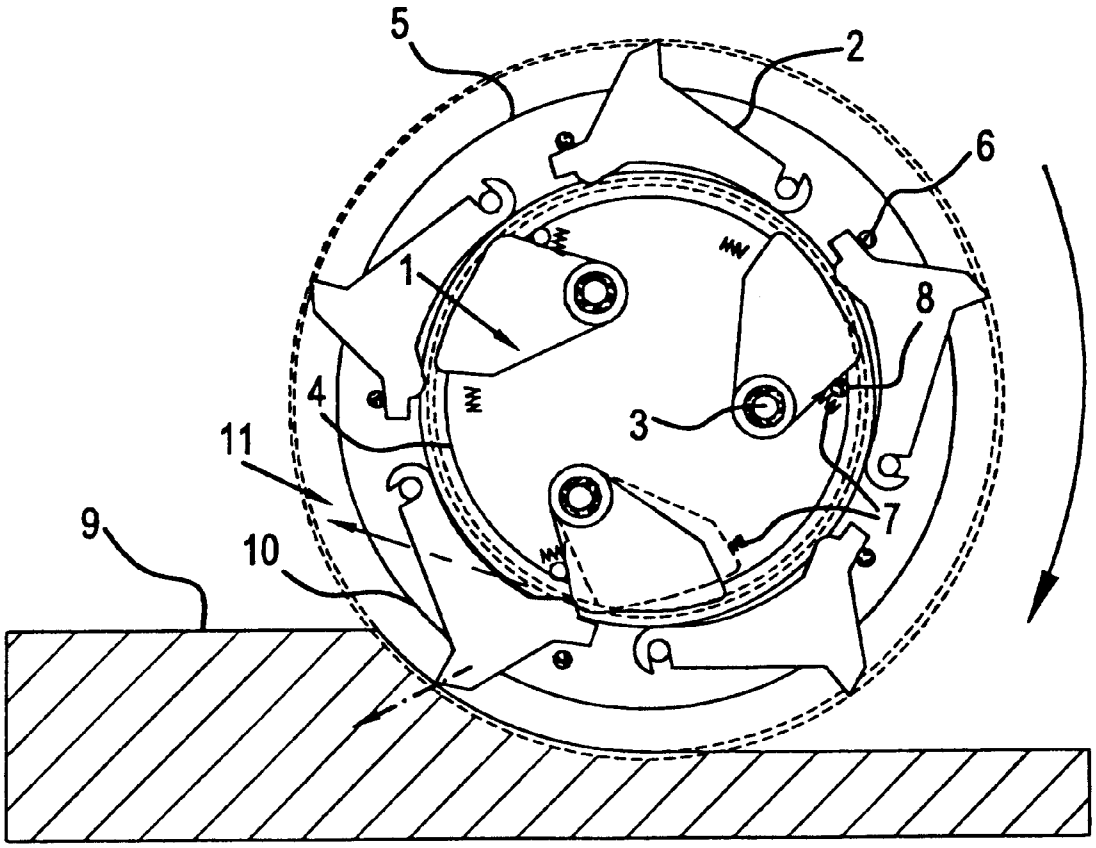
FIG. 1: a radial cross-section of the milling machine with chisels that are mounted such that they can rotate and with pendulums designed in accordance with claim 8.
Figure 2:
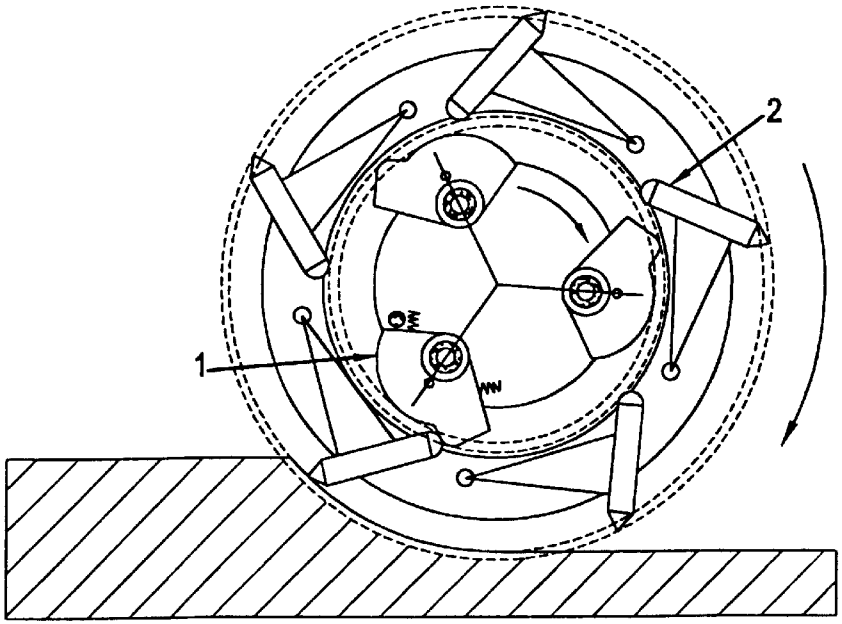
FIG. 2: a radial cross-section of the milling machine with chisels that are mounted such that they can rotate and with pendulums designed in accordance with claim 9.
Figure 3:
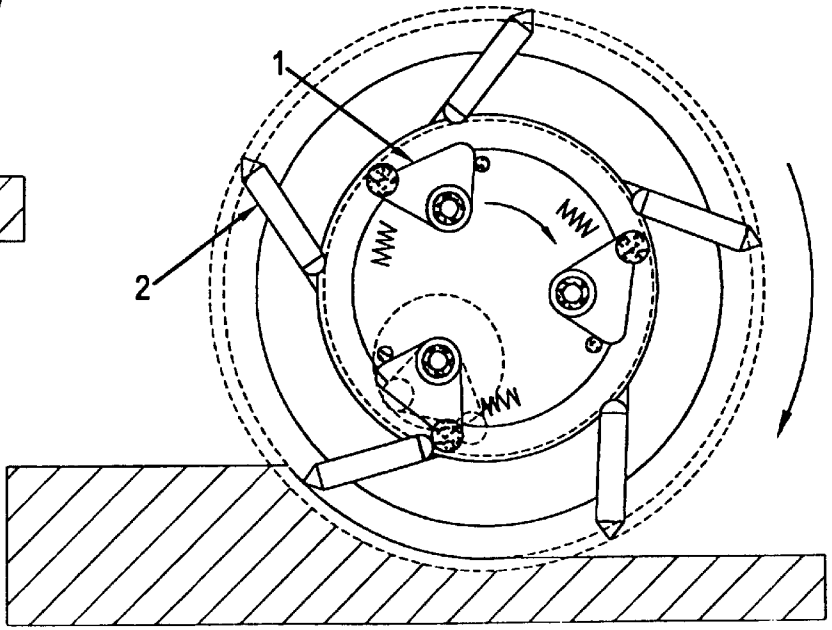
FIG. 3: a radial cross-section of the milling machine with chisels that are mounted linearly. Chisel stop devices are not illustrated here.

In FIG. 1 through 3, the turning joints 3 of the pendulums 1 are mounted on the pendulum shaft 4, shown here as roller bearings.

In FIG. 1, the pendulum shaft 4 also contains stop points 8 as stop devices for the pendulums, however damping or spring elements 7, which may also be used, are also shown in the final positions here. Outside, around the pendulum shaft 4, rotates the milling cylinder 5. Both are driven in the same direction of rotation (clockwise), but independent of one another and at different rpm's. The chisels 2 are pushed toward the outside, against outer stop points 6, by centrifugal force and/or by springs (not illustrated here). Only when the chisels 5 come into contact with the material being milled 9 are they pushed against the inside arrangement by the material being milled. In this position, the pendulums 1 come into contact with the chisels 5. At this moment, the pendulum is pushed, at the point of impact, in the direction 11, tangentially to its circular pathway. Based upon the geometry of the chisel and the pendulum at the area of impact, a resulting direction of the force of impact 10 is produced.

What is claimed is:

1. Milling machine with rotating milling tool comprising a rotating shaft, a milling cylinder mounted on the shaft, plural milling chisels arranged around a perimeter of the milling cylinder, at least one pendulum pivotably connected to the shaft and positioned within the milling cylinder for inducing a percussion effect on the chisel when the tool is in operation.

2. The milling machine of claim 1, wherein the chisels are rotatably mounted on the cylinder.

3. The milling machine of claim 2, further comprising inner and outer stops for limiting movement of the chisels wherein the inner stops establish an optimum point of impact for the pendulum, and the outer stops prevent further contact of the chisels with the pendulums.

4. The milling machine of claim 1, wherein the chisels are mounted along a circumference of the cylinder.

5. The milling machine of claim 1, wherein a speed of rotation of the shaft with the at least one pendulum is greater than a speed of rotation of the milling cylinder on the shaft.

6. The milling machine of claim 5, wherein a direction of rotation of the shaft is same as a direction of rotation of the milling cylinder.

7. The milling machine of claim 1, wherein a striking point of the pendulum on the chisel relative to the direction of rotation is behind a line connecting a center of rotation of the shaft and a center of rotation of the pendulum.

8. The milling machine of claim 7, wherein a center of gravity of the pendulum is behind the line.

9. The milling machine of claim 8, further comprising a stop device on the shaft for restricting movement of the pendulum by centrifugal force thereby establishing a maximum outward position for the pendulum.

10. The milling machine of claim 1, wherein a center of gravity of the pendulum is along a line connecting a center of rotation of the shaft with a center of rotation of the pendulum.

11. The milling machine of claim 1, further comprising stopping devices on the shaft for limiting pendulous movement of the pendulum in both directions.

12. The milling machine of claim 1, further comprising plural pendulums on the shaft, wherein the pendulums have varying sizes and shapes for optimizing impact frequency and impact power of the chisels.

13. The milling machine of claim 1, wherein the shaft and the cylinder rotate at different speeds which are independently variable for optimizing impact frequency and impact power of the chisels.

14. The milling machine of claim 1, wherein the pendulum and the chisels further comprise points of impact and geometries of areas of impact such that a resulting direction of a percussion force extends through tips of the chisels.

15. The milling machine of claim 14, wherein the points of impact on the pendulums and the chisels are of hard material.

16. The milling machine of claim 15, wherein the points of impact are of hard metal inserts.

17. The milling machine of claim 1, wherein the speed of rotation is variable.

18. The milling machine of claim 17, wherein the speed of rotation of the cylinder is such that a centripetal acceleration on the chisels is greater than twice the acceleration due to gravity.

19. The milling machine of claim 1, wherein a number of the chisels plane is selectively provided such that even at a greatest cutting depth for an individual cut only one chisel is pressed into material being milled at any one time which places the chisel selected in contact with the pendulum.

20. The milling machine of claim 1, further comprising plural independently floating separate pendulums.

21. The milling machine of claim 20, wherein the pendulums have a common direction of rotation along respective rotational axes.

22. The milling machine of claim 20, further comprising pendulum shafts, and wherein the pendulums are mounted on the pendulum shafts and are offset in a circumferential direction from a center of the rotating shaft.

23. The milling machine of claim 20, wherein multiple chisels are located axially adjacent to one another and wherein axially adjacent chisels are subject to impact by independent pendulums.

* * * * *